US008303725B2

(12) United States Patent
Crookshanks et al.

(10) Patent No.: US 8,303,725 B2
(45) Date of Patent: Nov. 6, 2012

(54) RACK HANDLE MEMBER FOR A DISHWASHER

(75) Inventors: Kent Allen Stephen Crookshanks, Anderson, SC (US); Ashwin Jadhav, New Bern, NC (US); Ronald Gene Tynes, Hendersonville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 789 days.

(21) Appl. No.: 12/105,648

(22) Filed: Apr. 18, 2008

(65) Prior Publication Data

US 2008/0272074 A1 Nov. 6, 2008

Related U.S. Application Data

(60) Provisional application No. 60/916,156, filed on May 4, 2007.

(51) Int. Cl.
*A47L 15/50* (2006.01)

(52) U.S. Cl. ..... 134/56 D; 134/57 D; 134/58 D; 211/41.8; 211/41.9; 312/228.1

(58) Field of Classification Search ..... 134/56 R, 134/57 R, 58 R, 56 D, 57 D, 58 D; 211/41.1, 211/41.2, 41.3, 41.4, 41.5, 41.6, 41.7, 41.8, 211/41.9; 312/228.1, 311
See application file for complete search history.

(56) References Cited

U.S. PATENT DOCUMENTS

| | | | | |
|---|---|---|---|---|
| 3,039,987 | A | 6/1962 | Elbling | |
| 3,146,045 | A * | 8/1964 | Kauffman | 312/229 |
| 3,292,984 | A * | 12/1966 | Pattison et al. | 312/229 |
| 3,861,769 | A * | 1/1975 | Jenkins | 312/311 |
| 4,064,887 | A | 12/1977 | Geiger et al. | |
| 4,834,125 | A | 5/1989 | Insalaco | |
| 5,284,683 | A | 2/1994 | Erhan | |
| 6,435,366 | B1 * | 8/2002 | Johnson et al. | 220/62.22 |
| 6,537,672 | B1 | 3/2003 | Dittfurth et al. | |
| 6,622,740 | B1 | 9/2003 | Durazzani | |
| 6,849,338 | B2 | 2/2005 | Clemens et al. | |

(Continued)

FOREIGN PATENT DOCUMENTS

DE 20 2005 004395 U1 5/2005

(Continued)

OTHER PUBLICATIONS

Office Action for Russian Patent Application No. 2009140385/12, dated Sep. 27, 2011.

(Continued)

*Primary Examiner* — Michael Barr
*Assistant Examiner* — Benjamin Osterhout

(74) *Attorney, Agent, or Firm* — Alston & Bird LLP

(57) ABSTRACT

A dishwasher includes lower and upper racks that slide in and out for loading and unloading of dishes. Either or both of the racks includes a handle secured to the front wall of the rack. The handle is molded from a thermoset polymer material and at least part of the handle is plated with a bright-finish metal coating such as powdered stainless steel. The handle for the lower rack extends above the upper edge of the front wall of the rack for easier accessibility. The upper handle is arranged to be contacted by the door of the dishwasher when the door is closed such that the upper rack is urged inwardly to a correct position for connecting a mid-level spray arm delivery tube to a check valve assembly of the water delivery system.

22 Claims, 3 Drawing Sheets

U.S. PATENT DOCUMENTS

| | | | | |
|---|---|---|---|---|
| 6,974,040 | B2 | 12/2005 | Jahrling | |
| 2002/0139809 | A1 * | 10/2002 | Barry et al. | 220/762 |
| 2002/0163285 | A1 | 11/2002 | Vanlandingham | |
| 2003/0193277 | A1 | 10/2003 | VanLandingham | |
| 2004/0163687 | A1 | 8/2004 | Son et al. | |
| 2005/0241686 | A1 | 11/2005 | Woo | |
| 2006/0254627 | A1 | 11/2006 | Lim | |
| 2006/0254994 | A1 | 11/2006 | Lim | |
| 2007/0079851 | A1 | 4/2007 | Park et al. | |

FOREIGN PATENT DOCUMENTS

| | | | |
|---|---|---|---|
| EP | 0 143 754 | A | 6/1985 |
| EP | 0 400 683 | A | 12/1990 |
| EP | 0 855 166 | B1 | 9/2002 |
| EP | 1 454 999 | A | 9/2004 |
| EP | 1 564 263 | A | 8/2005 |
| EP | 1 582 136 | A | 10/2005 |
| EP | 1 776 916 | A | 4/2007 |
| KR | 2004-0079623 | | 9/2004 |
| KR | 2006100708 | | 3/2005 |
| SU | 1243656 | A1 | 7/1986 |
| WO | WO 00/72741 | | 12/2000 |
| WO | WO 2004/054427 | A | 7/2004 |

OTHER PUBLICATIONS

Technical railway dictionary—The state transport railway publishing. N.N. Vasilyev, O.N. Isaakjan, N.O. Roginskij, J.B. Smoljanskij, V.A. Sokovich, T.S. Hachaturov, 1941; [online]; retrieved from the Internet <URL: http://dic.academic.ru/dic.nsf/railway/3030>; 2 pages; Internet translation of the webpage retrieved from the internet <URL: http://translate.googleusercontent.com/translate_c?hl=en&ie=UTF8&prev=_t&rurl=translate.google.com&sl=ru&tl=en&u=http://dic.academic.ru/dic.nsf/railway/3030&usg=ALkJrhjlbQRpBV1s3yp8CLERj-_nRKohPA> ; 2 pages.

Office Action issued for Korean Patent Application No. 10-2009-7025317, mailed Aug. 11, 2011.

* cited by examiner

RACK HANDLE MEMBER FOR A DISHWASHER

CROSS-REFERENCE TO RELATED APPLICATION

This application claims the benefit of the filing date of U.S. Provisional Patent Application Ser. No. 60/916,156 filed May 4, 2007, the entire disclosure of which is hereby incorporated herein by reference.

BACKGROUND OF THE INVENTION

1. Field of the Invention

Embodiments of the present invention relate to dishwasher appliances and, more particularly, to a rack handle member for a dishwasher appliance.

2. Description of Related Art

An automated dishwasher typically includes a lower rack and an upper rack, both of which slide in and out of the tub of the dishwasher to facilitate loading and unloading of dishes and utensils. In some such dishwashers, some type of handle or grasping region is provided on the front wall of each rack to allow the user to grasp and pull the rack out. Molded thermoplastic handles, for example, have been used for this purpose.

In some dishwashers, the upper rack supports a mid-level spray arm that moves with the upper rack when it is slid in and out of the dishwasher. The spray arm is supplied with water by a delivery tube that extends horizontally adjacent the lower surface of the upper rack. In some cases, the delivery tube is not permanently connected with the main supply conduit (which typically extends vertically adjacent the rear wall of the tub), but instead there is a check valve assembly associated with the main supply conduit, and the spray arm delivery tube is inserted into the check valve assembly when the upper rack is slid into its proper position for washing, thereby making a connection with the main supply conduit so that water will be supplied to the spray arm. In such dishwashers, it is important for the upper rack to be placed in the correct position, or else a proper connection may not be made. Some users of such dishwashers may not slide the upper rack all the way into the correct position, but may actually use the door of the dishwasher to push the upper rack in. In such circumstances, there is a risk that the mid-level spray arm may not function as intended.

Thus, there exists a need for an apparatus for a dishwasher appliance for ensuring rack members thereof are appropriately positioned within the tub portion when closed for operation of the dishwasher appliance.

BRIEF SUMMARY OF THE DISCLOSURE

The above and other needs are met by the present invention which, according to one aspect, provides a dishwasher comprising a tub portion having a bottom wall, a rear wall, a pair of spaced side walls, a top wall, and a front wall, the front wall being formed at least in part by a door member pivotable between an open position and a closed position. A lower rack is located proximate the bottom wall of the tub and is slidable into and out of the tub portion when the door member is in the open position, and an upper rack is spaced vertically above the lower rack and is slidable into and out of the tub portion when the door member is in the open position. At least the upper rack includes an upper handle formed separately from the upper rack, the upper handle being secured to the front wall of the upper rack and being positioned to be grasped and pulled for sliding the rack out of the dishwasher. The upper handle is configured such that moving the door member to the closed position causes the door member to contact and urge the upper handle inwardly so as to ensure that the upper rack is slid inwardly to a desired predetermined position with respect to the rear wall of the tub.

In another embodiment, a dishwasher comprises a tub portion having a bottom wall, a rear wall, a pair of spaced side walls, a top wall, and a front wall, the front wall being formed at least in part by a door member pivotable between an open position and a closed position. A lower rack is located proximate the bottom wall of the tub and is slidable into and out of the tub portion when the door member is in the open position, and an upper rack is spaced vertically above the lower rack and is slidable into and out of the tub portion when the door member is in the open position. A lower handle is formed separately from the lower rack. The lower handle is releasably secured to the front wall of the lower rack and positioned to be grasped and pulled for sliding the lower rack out of the tub portion, wherein the front wall of the lower rack has an upper edge. The lower handle projects vertically higher than the upper edge of the front wall.

According to another aspect, a dishwasher comprises a tub portion having a bottom wall, a rear wall, a pair of spaced side walls, a top wall, and a front wall, the front wall being formed at least in part by a door member pivotable between an open position and a closed position. A lower rack is located proximate the bottom wall of the tub portion and slidable into and out of the tub portion when the door is in the open position. An upper rack is spaced vertically above the lower rack and slidable into and out of the tub portion when the door is in the open position. Each rack has a bottom wall, a front wall extending generally vertically upwardly from a front edge of the bottom wall, a rear wall extending generally vertically upwardly from a rear edge of the bottom wall, and a pair of spaced side walls extending generally vertically upwardly from opposite side edges of the bottom wall. At least one handle member is formed separately from the lower and upper racks and releasably secured to the front wall of at least one of the upper and lower rack such that the at least one handle member is positioned to be grasped and pulled for sliding the corresponding rack out of the tub portion, wherein each handle member comprises a molded thermoset polymer structure having at least a portion of which is plated with a powdered metal coating.

According to yet another aspect, a handle member is adapted for a rack of a dishwasher, the rack being configured to maintain dishware therein. The dishwasher includes a tub portion defining an interior thereof, and the dishwasher further includes a door member pivotably engaged to the tub portion for providing closed and open positions to facilitate access to the interior thereof. The handle member is formed separately from the rack. The handle member is adapted to be secured to the front wall of the upper rack and positioned so as to be grasped and pulled for sliding the rack out of the tub portion. The handle member comprises a first handle portion and a second handle portion configured to engage the first handle portion and adapted to capture a part of a rack therebetween in order to secure the handle member to the rack. The handle portions comprise a molded thermoset polymer material, and at least one of the handle portions has a plating of a powdered metal coating. The handle member is adapted such that moving the door member to the closed position causes the door member to contact and urge the handle member inwardly so as to ensure that the rack is slid inwardly to a desired predetermined position with respect to the rear wall of the tub portion.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
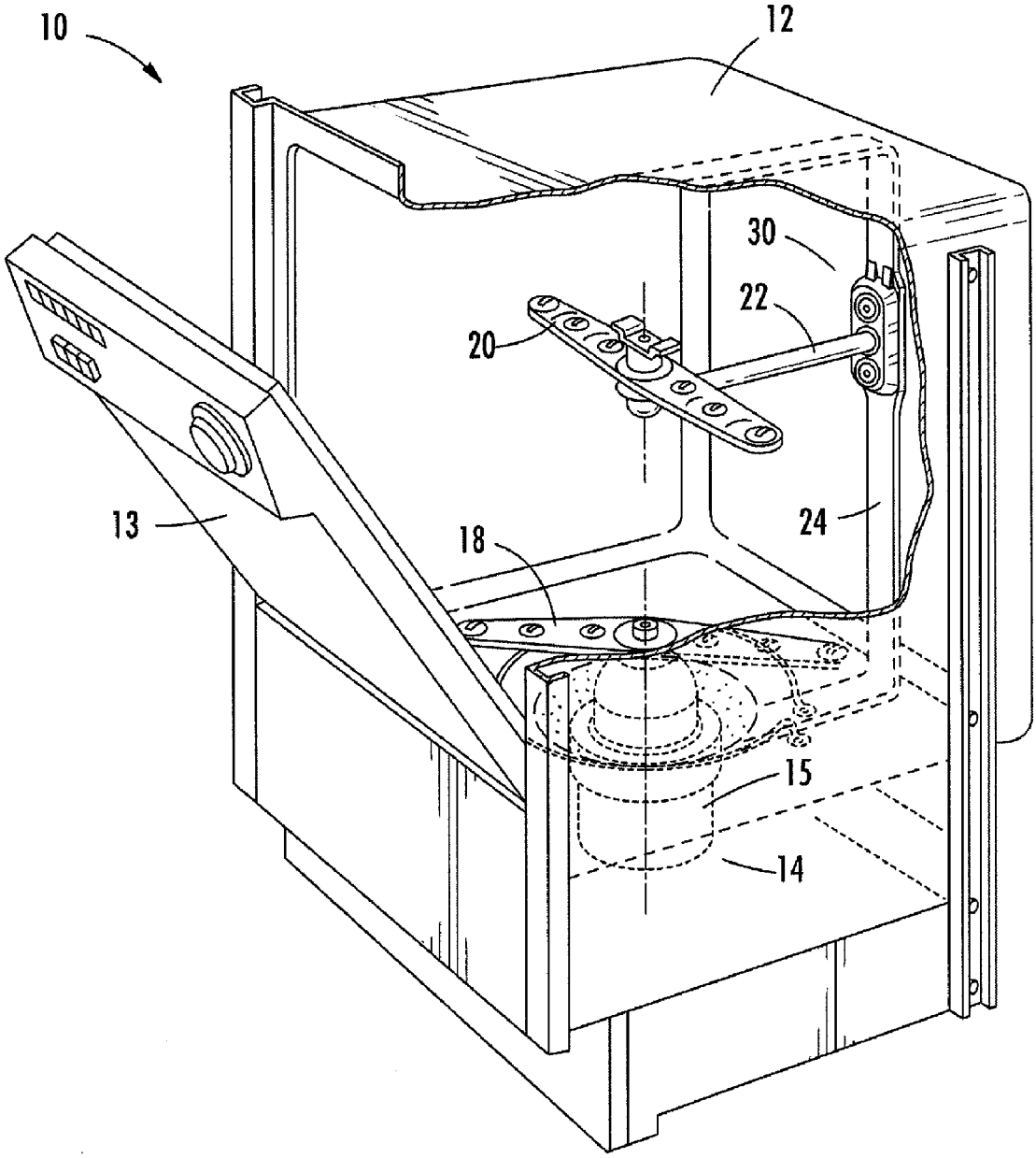
FIG. 1 is a perspective view of a dishwasher of a type suitable for use with various embodiments of the present disclosure.

FIG. 1 shows a dishwasher 10 as an example of one type of dishwasher with which the present invention may be used. The dishwasher includes a tub 12 (partly broken away in FIG. 1 to show internal details) forming an enclosure in which dishes, utensils, and dishware may be placed for washing. The tub includes a door 13 that may be opened to access the interior of the tub. As well known in the art, the dishwasher includes a bottom rack and an upper rack (omitted from FIG. 1 for clarity, but shown in FIGS. 2 through 5) for holding the dishes, dishware, and utensils. Each of the racks is mounted to slide inwardly and outwardly through the open door to facilitate loading and unloading of dishes, dishware, and utensils. The tub also defines a sump (shown generally designated as 14 in FIG. 1) in which wash water or rinse water is collected. The water is pumped by a pump 15 from the sump 14 to various spray arms mounted in the interior of the tub for spraying the water under pressure onto the dishes, dishware, and utensils. The spray arms may be rotatable for ensuring that all areas in the interior of the tub are exposed to the water discharged from the spray arms.

In some instances, the upper rack may be adjustable to different vertical positions. This allows the user to lower the rack when inordinately tall items are to be placed in the upper rack, or to raise the rack when more vertical space is needed for items in the lower rack. In the illustrated embodiment, for example, the upper rack has three different positions that can be selected.

The spray arms typically include an uppermost spray arm (not shown) mounted to an underside of an upper wall of the tub 12 for spraying water generally downwardly, and a lowermost spray arm 18 mounted on an upper side of a bottom wall of the tub for spraying water generally upwardly. The spray arms also include a mid-level spray arm 20 that is attached to an underside of the upper rack and is configured for spraying water both upwardly and downwardly. The spray arm 20 is supplied with water via a delivery tube 22 that extends generally horizontally along the underside of the upper rack. As will be appreciated by those of skill in the art, when the upper rack is adjusted to different vertical positions, the delivery tube 22 moves with the upper rack and thus also assumes different vertical positions.

The water delivery system for the spray arm 20 may include a main supply conduit 24 that connects to the pump 15 at the lower end of the conduit, extends generally vertically upwardly adjacent a rear wall of the tub 12, and then turns to extend generally horizontally along the underside of the upper wall of the tub for supplying water to the uppermost spray arm. Along the generally vertical portion of the main supply conduit may be a check valve assembly 30 that cooperates with the delivery tube 22 to supply water to the mid-level spray arm 20. In such instances, the check valve assembly 30 allows the delivery tube 22 to be fluidly coupled with the main supply conduit 24 when the upper rack is slid all the way into the interior of the tub 12, and to be disconnected from the main supply conduit when the upper rack is slid out for loading or unloading dishes and utensils. As further described below, in some instances, it may be desirable for the upper rack to be slid into the tub and into the correct position with respect to the rear wall of the tub in order for the proper connection to be made between the delivery tube 22 and the supply conduit 24.

As noted, and with reference to FIGS. 2-5, the dishwasher may include a lower rack 40 (FIGS. 2 and 3) located proximate the bottom wall of the tub and slidable into and out of the tub when the door is in the open position, and an upper rack 60 (FIGS. 4 and 5) spaced vertically above the lower rack and slidable into and out of the tub when the door is in the open position (i.e., not blocking access to the interior of the tub). Each of the racks 40, 60 may be formed generally as a wire frame structure comprising, for example, a plurality of wires arranged to intersect one another at discrete points at which the wires are secured to one another. In some embodiments, the lower rack 40 may have a bottom wall 42, a front wall 44 extending generally vertically upwardly from a front edge of the bottom wall, a rear wall 46 extending generally vertically upwardly from a rear edge of the bottom wall, and a pair of spaced side walls 48 extending generally vertically upwardly from opposite side edges of the bottom wall.

Similarly, the upper rack 60 may have a bottom wall 62, a front wall 64 extending generally vertically upwardly from a front edge of the bottom wall, a rear wall (not shown) extending generally vertically upwardly from a rear edge of the bottom wall, and a pair of spaced side walls 68 (only one visible in FIG. 5) extending generally vertically upwardly from opposite side edges of the bottom wall.

In some embodiments, the front wall 44, 64 of each rack may include at least two generally horizontal wires **44*h*, 64*h*, respectively, spaced apart in a vertical direction and a plurality of generally vertical wires 44*v*, 64*v***, respectively, spaced apart horizontally and secured to the at least two generally horizontal wires.

Figure 3:
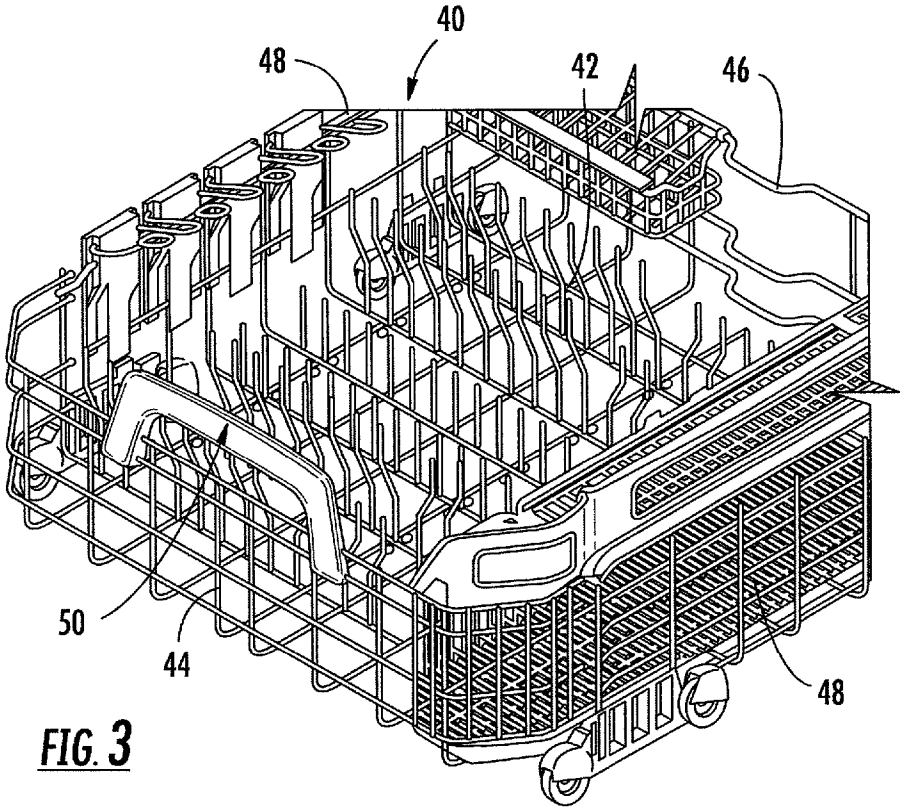
FIG. 3 is another perspective view of the lower rack of FIG. 2 having the handle member secured thereto, according to one embodiment of the present disclosure.
Figure 2:
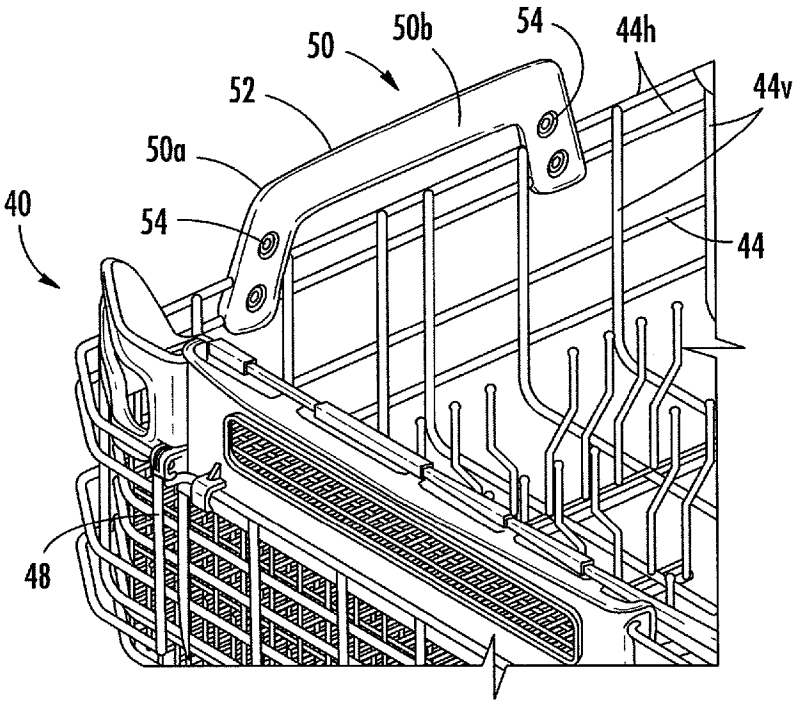
FIG. 2 is a perspective view of a portion of a lower rack of a dishwasher, the lower rack having a handle member secured thereto, according to one embodiment of the present disclosure.

The dishwasher may include a lower handle 50 secured to the front wall 44 of the lower rack 40, as shown in FIGS. 2 and 3. In some instances, the lower handle 50, as in the illustrated embodiment, may have, for example, an inverted generally U-shaped configuration that includes a grasping portion 52 and a pair of legs 54 respectively projecting generally downward from the opposite ends of the grasping portion. The handle 50 may be formed to have two portions **50*a* and 50*b*** each of which has the inverted generally U-shaped configuration. The two handle portions 50*a*, 50*b* may be secured to each other in a suitable fashion (e.g., by fasteners such as screws, by a snap-fit engagement, by adhesive, or the like) with a portion of the front wall 44 of the lower rack captured between the two handle portions 50*a*, 50*b*. In such instances, the handle portion 50*a* faces toward the door of the dishwasher and the other handle portion 50*b* faces toward the rear wall of the tub. In the illustrated embodiment, the two uppermost horizontal wires 44*h* of the front wall are captured between the two handle portions 50*a*, 50*b* in the region of the legs 54 of the handle. Each of the handle portions 50*a*, 50*b* may comprise a part molded from a polymer material in such a fashion that each handle portion has one side that is convex outwardly and an opposite side that is concave outwardly. The handle portions 50*a*, 50*b* may fit together with their concave sides facing each other, and thus the convex sides form the opposite surfaces of the handle 50 that will be grasped by the user. The edges of each handle portion 50*a*, 50*b* may define recesses for receiving the wires of the front wall 44. Thus, as shown in FIGS. 2 and 3, the lower handle portions 50*a*, 50*b* may be form-fitted with the lower rack 40. The handle portions 50*a*, 50*b* may be entirely separate from each other until they are secured together in any of the fashions previously noted; alternatively, the two handle portions may comprise a single one-piece member wherein, for example, a living hinge connects the handle portions to each other to allow them to be spread apart for engaging them around the front wall of the lower rack, after which the handle portions can be fit together and secured to each other as noted.

The lower handle 50 may be configured and arranged with respect to the front wall 44 of the lower rack such that the grasping portion 52 of the handle is spaced above the upper edge of the front wall (which is defined by the uppermost horizontal wire 44*h*) a sufficient distance so that a user's fingers can extend between the grasping portion 52 and the upper edge of the front wall. In this manner, the lower handle 50 is more easily accessible to the user and reduces the amount by which the user must bend down in order to grasp the grasping portion 52 to pull the lower rack 40 out from the dishwasher tub.

In accordance with one aspect of the invention, the handle portions 50*a*, 50*b* may be molded from a thermoset polymer material. Any of various thermoset polymer materials known in the art can be used, including but not limited to melamine resins, polyurethane resins, epoxy resins, unsaturated polyester resins, and the like.

In accordance with another aspect of the invention, at least the outwardly facing (convex) surface of at least the front handle portion 50*a* may be plated with a powdered metal coating or any other suitable coating. The powdered metal coating may comprise, for example, a stainless steel powder, such as 304SS. In some instances, the coating may provide a mirror finish. Stainless steel is highly resistant to rust and avoids the use of any heavy metals (e.g., chromium, nickel, or the like, which are typical materials for achieving bright mirror finishes) that potentially could leach out and contaminate the dishes and utensils being washed.

Figure 5:
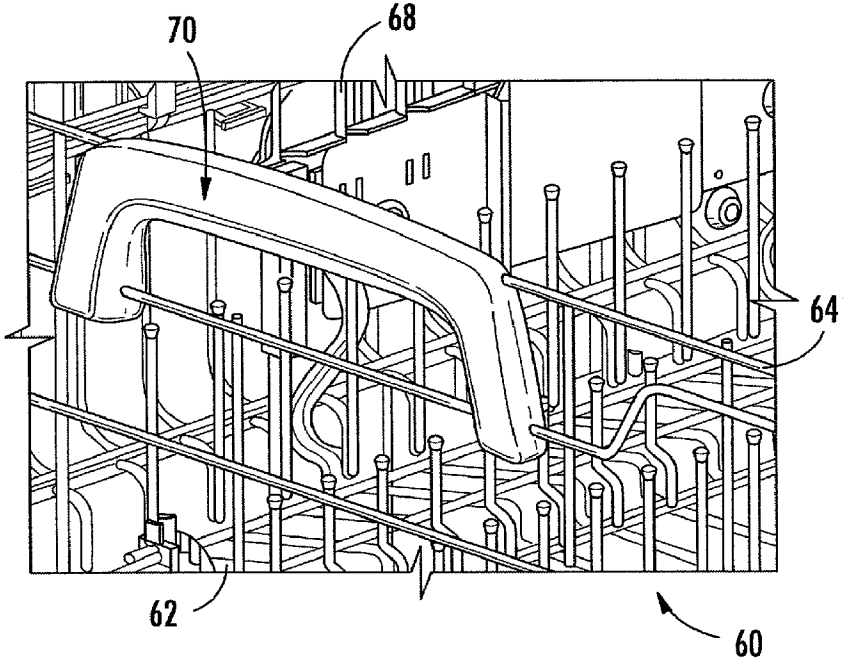
FIG. 5 is another perspective view of the upper rack of FIG. 4 having the handle member secured thereto, according to one embodiment of the present disclosure.
Figure 4:
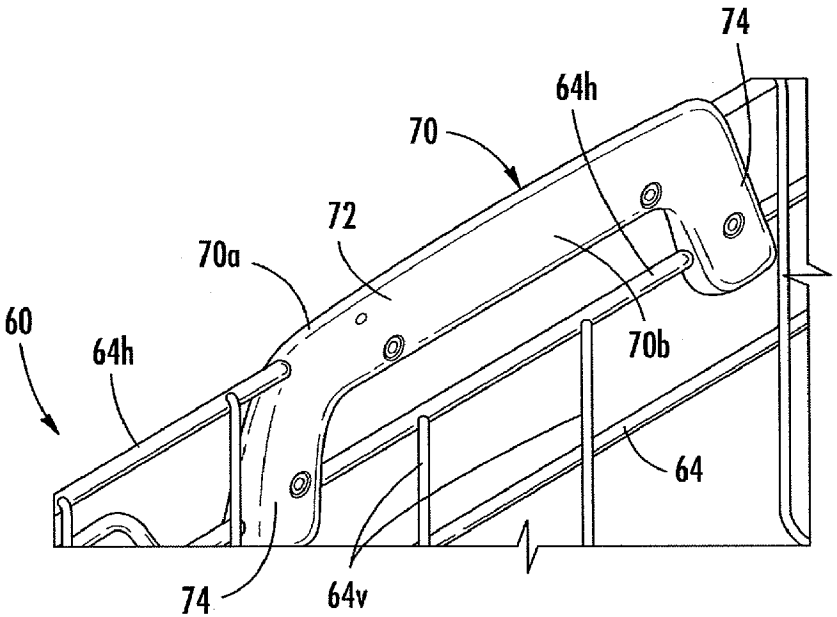
FIG. 4 is a perspective view of a portion of an upper rack of a dishwasher, the upper rack having a handle member secured thereto, according to one embodiment of the present disclosure.

With reference to FIGS. 4 and 5, the upper rack 60 similarly may have an upper handle 70 secured to the front wall 64 of the upper rack. In some instances, the upper handle 70, as in the illustrated embodiment, may have an inverted generally U-shaped configuration that includes a grasping portion 72 and a pair of legs 54 respectively projecting generally downward from the opposite ends of the grasping portion. The handle 70 may be formed to have two portions 70*a* and 70*b*, each of which may have the inverted generally U-shaped configuration. The two handle portions 70*a*, 70*b* may be secured to each other in suitable fashion (e.g., using fasteners such as screws, by a snap-fit engagement, using adhesive, or the like) with a portion of the front wall 64 of the upper rack captured between the two handle portions. In such instances, the handle portion 70*a* may face toward the door of the dishwasher and the other handle portion 70*b* faces toward the rear wall of the tub. In the illustrated embodiment, the uppermost horizontal wire 64*h* of the front wall may be captured between the two handle portions 70*a*, 70*b* in the region of the grasping portion 72 of the handle, and the next-to-uppermost horizontal wire 64*h* is captured between the handle portions in the region of the legs 74. Each of the handle portions 70*a*, 70*b* may comprise a part molded from a polymer material in such a fashion that each handle portion has one side that is convex outwardly and an opposite side that is concave outwardly. The handle portions may fit together with their concave sides facing each other, and thus the convex sides form the opposite surfaces of the handle 70 that will be grasped by the user. The edges of each handle portion 70*a*, 70*b* may define recesses for receiving the wires of the front wall 64. Thus, as shown in FIGS. 4 and 5, the upper handle portions 70*a*, 70*b* may be form-fitted with the upper rack 60. The handle portions 70*a*, 70*b* may be entirely separate from each other until they are secured together in any of the fashions previously noted; alternatively, the two handle portions may comprise a single one-piece member wherein, for example, a living hinge connects the handle portions to each other to allow them to be spread apart for engaging them around the front wall of the lower rack, after which the handle portions can be fit together and secured to each other as noted.

The upper handle 70 may be configured and arranged with respect to the front wall 64 of the upper rack such that the grasping portion 72 of the handle is at approximately the same level as the upper edge of the front wall (which is defined by the uppermost horizontal wire 64*h*). There may be a sufficient distance between the grasping portion 72 and the next-to-uppermost horizontal wire 64*h* such that a user's fingers may extend between the grasping portion 72 and that wire.

In accordance with one aspect of the invention, the handle portions 70*a*, 70*b* may be molded from a thermoset polymer material. Any of various thermoset polymer materials known in the art can be used, including but not limited to melamine resins, polyurethane resins, epoxy resins, unsaturated polyester resins, and the like.

In accordance with another aspect of the invention, at least the outwardly facing (convex) surface of at least the front handle portion 70*a* may be plated with a powdered metal coating or any other suitable coating. In some embodiments, the powdered metal coating may comprise, for example, a stainless steel powder, such as 304SS.

A further aspect of the invention relates to the proper functioning of the check valve assembly 30 (FIG. 1) to connect the mid-level spray arm delivery tube 22 to the main supply conduit 24. As previously noted, if the upper rack 60 is not slid into the proper position in the tub, a proper connection may not be made between the delivery tube 22 and the main supply conduit 24. In order to ensure that the upper rack 60 is placed in the correct position when the door 13 is closed, the upper handle 70 may be configured and arranged to be contacted by the inner surface of the door 13 when the door is closed. In the event that the upper rack initially was not slid far enough in to properly engage the delivery tube 22 in one of the ports of the check valve assembly 30, the door may be configured to push on the upper handle 70 and urge the upper rack further inwardly to the correct position (but also avoids pushing the rack too far inwardly).

It will be recognized that the handles 50, 70 described herein may be used in virtually all types of dishwashers that have racks that slide in and out, and are not limited to being used on dishwashers having the particular type of mid-level spray arm and water delivery system as described herein.

Many modifications and other embodiments of the inventions set forth herein will come to mind to one skilled in the art to which these inventions pertain having the benefit of the teachings presented in the foregoing descriptions and the associated drawings. For example, both handle portions of a given handle may be plated with powdered stainless steel if desired. The handles may have shapes different from those illustrated and described herein, and/or the handles may be attached to the racks in ways different from those described herein. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dishwasher, comprising:

a tub portion having a bottom wall, a rear wall, a pair of spaced side walls, a top wall, and a front wall, the front wall being formed at least in part by a door member movable between an open position and a closed position;

a lower rack located proximate to the bottom wall of the tub portion and slidable into and out of the tub portion when the door member is in the open position, and an upper rack spaced vertically above the lower rack and slidable into and out of the tub portion when the door member is in the open position, each rack having a bottom wall, a front wall extending generally vertically upwardly from a front edge of the bottom wall, a rear wall extending generally vertically upwardly from a rear edge of the bottom wall, and a pair of spaced side walls extending generally vertically upwardly from opposite side edges of the bottom wall; and an upper handle formed separately from the upper rack, the upper handle comprising a first handle portion and a second handle portion formed separately from the first handle portion and engaging the first handle portion, the first and second handle portions being form-fitted with the upper rack so as to capture a part of the upper rack therebetween to secure the handle member to the upper rack, wherein the handle member is positioned to be grasped and pulled for sliding the rack out of the tub portion, wherein the upper handle is configured such that moving the door member to the closed position causes the door member to contact and urge the upper handle inwardly of the tub portion so as to ensure that the upper rack is slid inwardly to a desired predetermined position with respect to the rear wall of the tub portion.

2. A dishwasher according to claim 1, wherein the first handle portion faces toward the door member and is capable of contacting the door member in the closed position thereof and the second handle portion faces toward the rear wall of the tub portion, wherein the handle portions comprise a molded thermoset polymer material, and at least the first handle portion is plated with a powdered metal coating.

3. A dishwasher according to claim 2, wherein the powdered metal coating comprises a stainless steel powder.

4. A dishwasher according to claim 1, further comprising a lower handle formed separately from the lower rack, the lower handle being releasably secured to the front wall of the lower rack and being positioned to be grasped and pulled for sliding the lower rack out of the tub portion, wherein the front wall of the lower rack has an upper edge, and the lower handle projects vertically higher than the upper edge of the front wall.

5. A dishwasher according to claim 4, wherein the lower handle comprises a third handle portion and a separately formed fourth handle portion, the third and fourth handle portions receiving a portion of the front wall of the lower rack therebetween and being secured to each other so as to fasten the lower handle to the front wall of the lower rack, the third handle portion facing toward the door member and the fourth handle portion facing toward the rear wall of the tub portion.

6. A dishwasher according to claim 5, wherein the handle portions of the lower handle comprise a molded thermoset polymer material, and at least the third handle portion is plated with a powdered metal coating.

7. A dishwasher according to claim 6, wherein the powdered metal coating comprises a stainless steel powder.

8. The dishwasher according to claim 1, wherein the first handle portion is secured to the second handle portion by at least one of screws, snap-fit engagement, or adhesive.

9. The dishwasher according to claim 1, wherein the first handle portion is hingedly connected to the second handle portion.

10. The dishwasher according to claim 1, wherein the first handle portion and the second handle portion are secured around the part of the upper rack, wherein the first handle portion and the second handle portion are adjacently engaged to opposing sides of the part of the upper rack respectively such that the part of the upper rack is fully enclosed by the first handle portion and second handle portion.

11. The dishwasher according to claim 1, wherein the first handle portion and the second handle portion are secured together around at least one wire of the upper rack, wherein the first handle portion and the second handle portion each define recesses for receiving the at least one wire of the upper rack therebetween.

12. The dishwasher according to claim 1, wherein the first handle portion and the second handle portion are secured together with fasteners to capture at least one wire of the upper rack therebetween.

13. The dishwasher according to claim 1, wherein the first handle portion and the second handle portion each define a convex side and a concave side, and wherein the first handle portion and the second handle portion are secured together such that the concave sides face each other and capture the part of the upper rack therebetween.

14. A dishwasher, comprising:

a tub portion comprising a bottom wall, a rear wall, a pair of spaced side walls, a top wall, and a front wall, the front wall being formed at least in part by a door member movable between an open position and a closed position;

a lower rack located proximate the bottom wall of the tub portion and slidable into and out of the tub portion when the door member is in the open position, and an upper rack spaced vertically above the lower rack and slidable into and out of the tub portion when the door member is in the open position, each rack having a bottom wall, a front wall extending generally vertically upwardly from a front edge of the bottom wall, a rear wall extending generally vertically upwardly from a rear edge of the bottom wall, and a pair of spaced side walls extending generally vertically upwardly from opposite side edges of the bottom wall; and a lower handle formed separately from the lower rack, the lower handle comprising a first handle portion and a second handle portion formed separately from the first handle portion and engaging the first handle portion, the first and second handle portions being form-fitted with the lower rack so as to capture a part of the lower rack therebetween to secure the handle member to the lower rack, wherein the handle is positioned to be grasped and pulled for sliding the lower rack out of the tub portion, wherein the front wall of the lower rack has an upper edge, and the lower handle projects vertically higher than the upper edge of the front wall.

15. A dishwasher according to claim 14, wherein the lower handle has an inverted generally U-shaped configuration formed by a grasping portion and a pair of legs respectively projecting from opposite ends of the grasping portion, wherein the legs are secured to the front wall of the lower rack and the grasping portion is spaced above the upper edge of the front wall so as to permit access between the grasping portion and the upper edge of the front wall.

16. A dishwasher according to claim 14, wherein the lower handle comprises a molded thermoset polymer material, and at least one of the handle portions being plated with a metal powder coating.

17. A dishwasher, comprising:

a tub portion comprising a bottom wall, a rear wall, a pair of spaced side walls, a top wall, and a front wall, the front wall being formed at least in part by a door member pivotable between an open position and a closed position;

a lower rack located proximate the bottom wall of the tub portion and slidable into and out of the tub portion when the door is in the open position, and an upper rack spaced vertically above the lower rack and slidable into and out of the tub portion when the door is in the open position, each rack having a bottom wall, a front wall extending generally vertically upwardly from a front edge of the bottom wall, a rear wall extending generally vertically upwardly from a rear edge of the bottom wall, and a pair of spaced side walls extending generally vertically upwardly from opposite side edges of the bottom wall; and at least one handle member formed separately from the lower and upper racks, wherein the at least one handle member comprises a first handle portion and a second handle portion formed separately from the first handle portion and engaging the first handle portion, the first and second handle portions being form-fitted with at least one of the upper or lower rack so as to capture a part of at least one of the upper or lower rack therebetween to secure the handle member to the at least one upper or lower rack, wherein the at least one handle member is positioned to be grasped and pulled for sliding the corresponding rack out of the tub portion, wherein the at least one handle member comprises a molded thermoset polymer structure having at least a portion thereof plated with a powdered metal coating.

18. A dishwasher according to claim 17, wherein the powdered metal coating comprises a stainless steel powder.

19. A dishwasher according to claim 17, wherein the at least one handle member comprises a lower handle secured to the front wall of the lower rack and an upper handle secured to the front wall of the upper rack, and at least a portion of each handle member is plated with the powdered metal coating.

20. A dishwasher according to claim 19, wherein each handle member comprises a forward portion corresponding to the first handle portion and a rear portion corresponding to the second handle portion, each forward portion facing the door member and each rear portion facing the rear wall of the tub portion, and wherein each forward portion is plated with the powdered metal coating.

21. A handle member configured for a rack of a dishwasher, the rack being configured to maintain dishware therein, and the dishwasher having a tub portion defining an interior thereof, the dishwasher further having a door member pivotably engaged to the tub portion for providing closed and open positions to facilitate access to the interior thereof, the handle member being formed separately from the rack, and the handle member configured to be secured to the front wall of the upper rack and positioned so as to be grasped and pulled for sliding the rack out of the tub portion, the handle member comprising: a first handle portion and a second handle portion formed separately from the first handle portion and engaging the first handle portion, the first and second handle portions being form-fitted with the rack so as to capture a part of a rack therebetween in order to secure the handle member to the rack, the handle portions comprising a molded thermoset polymer material, and at least one of the handle portions having a plating of a powdered metal coating, and the handle member being configured such that moving the door member to the closed position causes the door member to contact and urge the handle member inwardly so as to ensure that the rack is slid inwardly to a desired predetermined position with respect to the rear wall of the tub portion.

22. A handle member according to claim 21, wherein the powdered metal coating comprises stainless steel powder.

* * * * *